US006677530B2

(12) United States Patent
Blaha et al.

(10) Patent No.: US 6,677,530 B2
(45) Date of Patent: Jan. 13, 2004

(54) CUSHIONED GRIP TWIST-ON WIRE CONNECTOR

(75) Inventors: William E. Blaha, St. Charles, IL (US); Sushil N. Keswani, Sycamore, IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 09/897,255

(22) Filed: Jul. 2, 2001

(65) Prior Publication Data

US 2002/0050387 A1 May 2, 2002

Related U.S. Application Data

(63) Continuation-in-part of application No. 09/374,032, filed on Aug. 13, 1999, now abandoned.

(51) Int. Cl.[7] ..... H01R 4/00
(52) U.S. Cl. ..... 174/84 R; 174/87
(58) Field of Search ..... 174/74 R, 76, 174/82, 83, 84 R, 87, 88 R, 84 C; 439/415

(56) References Cited

U.S. PATENT DOCUMENTS

| | | | | |
|---|---|---|---|---|
| 2,890,266 | A | | 6/1959 | Bollmeier |
| D186,596 | S | | 11/1959 | Schinske |
| D186,597 | S | | 11/1959 | Schinske |
| D186,600 | S | | 11/1959 | Schinske |
| 3,001,002 | A | | 9/1961 | Schinske |
| 3,056,851 | A | | 10/1962 | Scott |
| 3,075,038 | A | | 1/1963 | Schinske |
| 3,097,257 | A | | 7/1963 | Cheney |
| D196,112 | S | | 8/1963 | Esser |
| 3,156,761 | A | | 11/1964 | Schinske |
| D200,538 | S | | 3/1965 | Esser |
| 3,297,816 | A | | 1/1967 | Waddington |
| 3,448,223 | A | | 6/1969 | Thorsman |
| 3,519,707 | A | | 7/1970 | Krup |
| D223,611 | S | | 5/1972 | Anderson |
| 3,676,574 | A | | 7/1972 | Johansson et al. |
| D233,891 | S | | 12/1974 | Aldighieri |
| 3,875,324 | A | | 4/1975 | Waddington et al. |
| 3,902,005 | A | | 8/1975 | Norden |
| 4,220,811 | A | | 9/1980 | Scott |
| 4,227,040 | A | | 10/1980 | Scott |
| 4,288,657 | A | | 9/1981 | Swanson |
| 4,691,079 | A | | 9/1987 | Blaha |
| D315,139 | S | | 3/1991 | Blaha |
| D315,143 | S | | 3/1991 | Blaha |
| 5,001,301 | A | | 3/1991 | Marr et al. |
| 5,023,401 | A | | 6/1991 | Clifton |
| 5,113,037 | A | | 5/1992 | King, Jr. et al. |
| 5,132,494 | A | | 7/1992 | Burton et al. |
| 5,151,239 | A | | 9/1992 | King, Jr. |
| D339,106 | S | | 9/1993 | McLaughlin et al. |
| 5,260,515 | A | | 11/1993 | Braun, Jr. |
| D345,962 | S | | 4/1994 | Clifton et al. |
| 5,531,618 | A | | 7/1996 | Market |
| 5,557,069 | A | | 9/1996 | Whitehead et al. |
| 5,557,070 | A | | 9/1996 | Tamm |
| 5,559,307 | A | | 9/1996 | Whitehead et al. |
| D379,348 | S | | 5/1997 | Korinek |
| 5,894,110 | A | * | 4/1999 | Simmons et al. ..... 174/87 |
| 6,025,559 | A | | 2/2000 | Simmons |
| 6,198,049 | B1 | | 3/2001 | Korinek |

* cited by examiner

*Primary Examiner*—William H. Mayo, III
(74) *Attorney, Agent, or Firm*—Cook, Alex, McFarron, Manzo, Cummings & Mehler, Ltd.

(57) ABSTRACT

A twist-on wire connector has a shell of relatively rigid plastic material with at least a portion of the shell exterior covered by a cushioned grip of relatively softer material. The cushioned grip has a higher coefficient of friction than the shell material to provide both a softer feel and, an improved gripping ability.

28 Claims, 7 Drawing Sheets

10
12
14
16
17
18
20
22
24
26
28
30
32
34
36
38
40
42
44
46
48
50
52

Fig. 5.
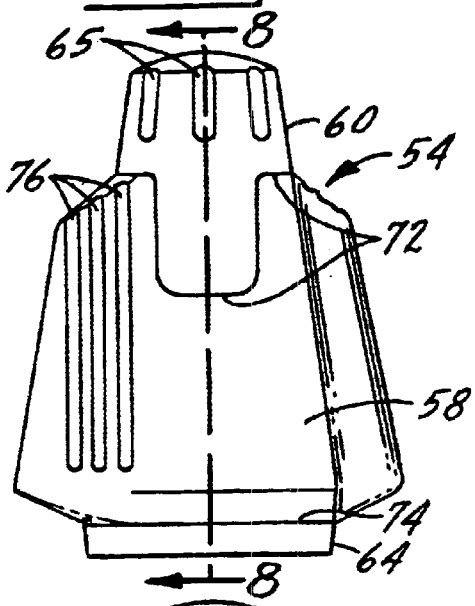
Fig. 8.
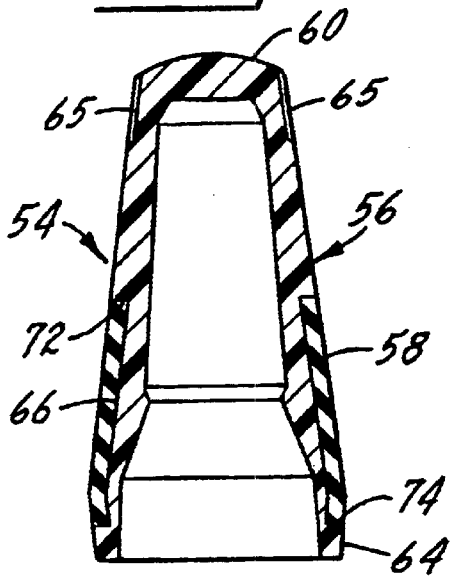
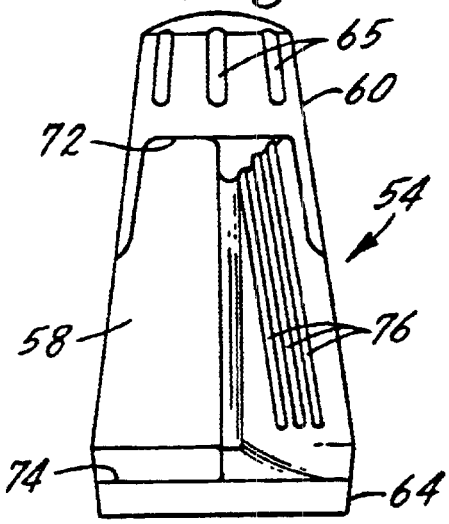
Fig. 6.
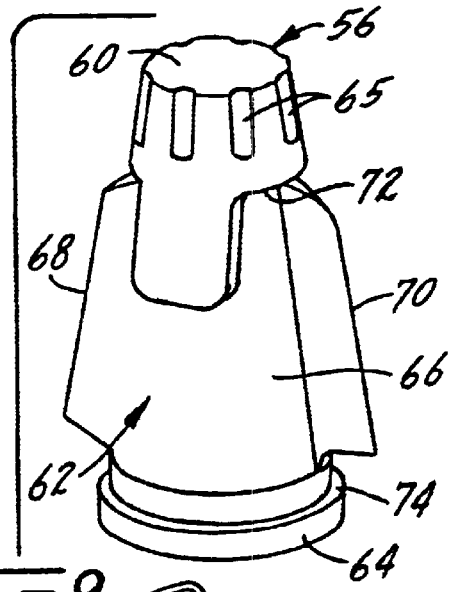
Fig. 9.
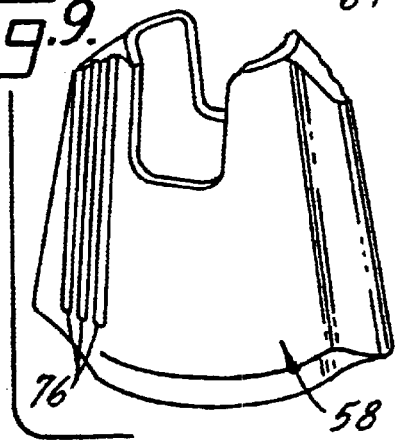
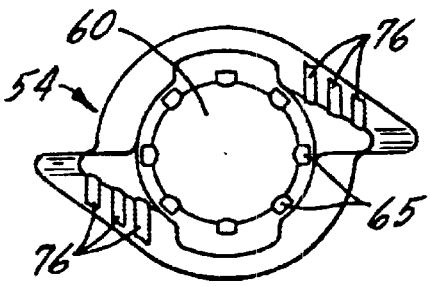
Fig. 7.

Fig. 25.
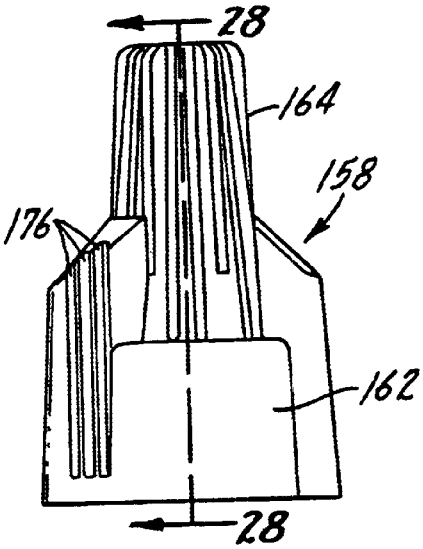
Fig. 28.
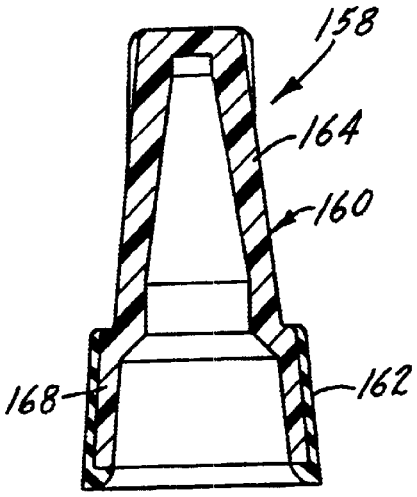
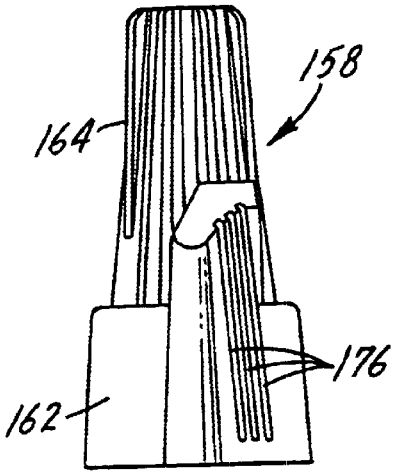
Fig. 26.
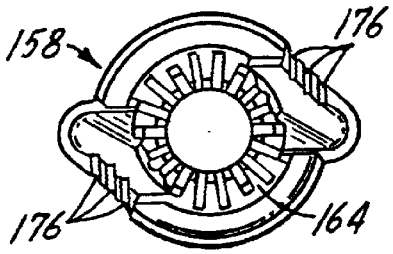
Fig. 27.
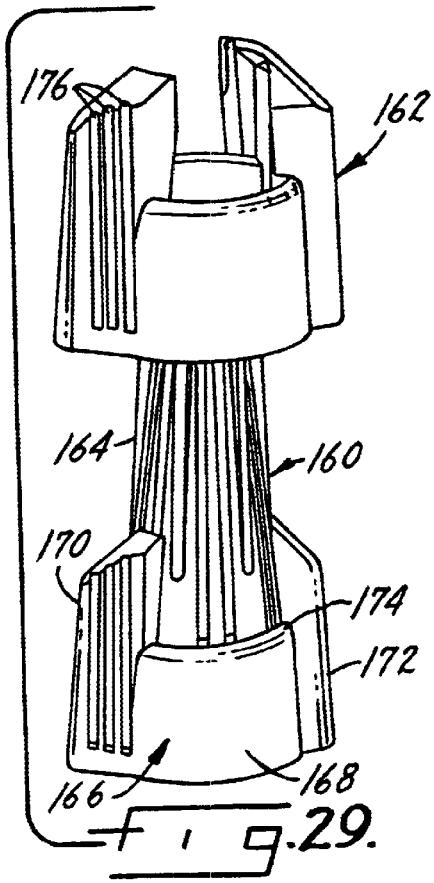
Fig. 29.

Fig. 30.
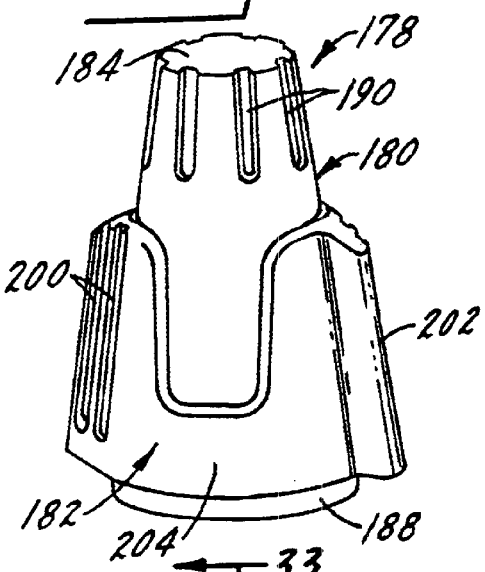
Fig. 33.
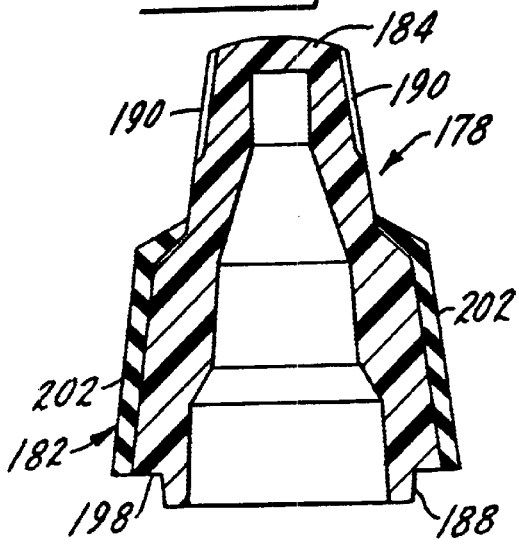
Fig. 31.
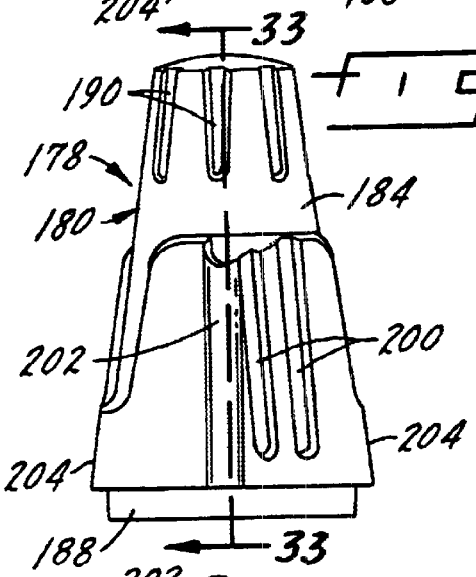
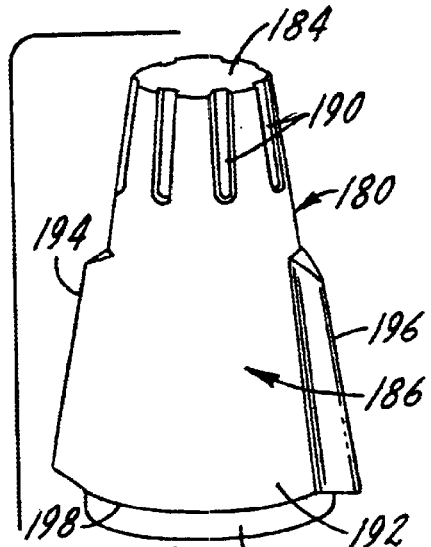
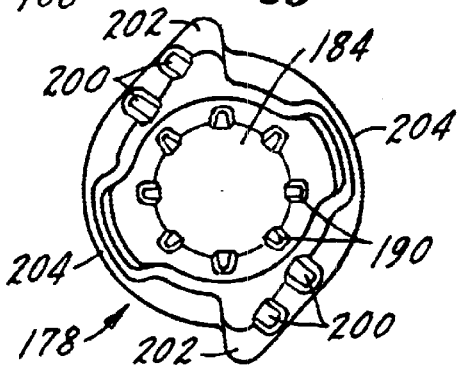
Fig. 32.
Fig. 34.
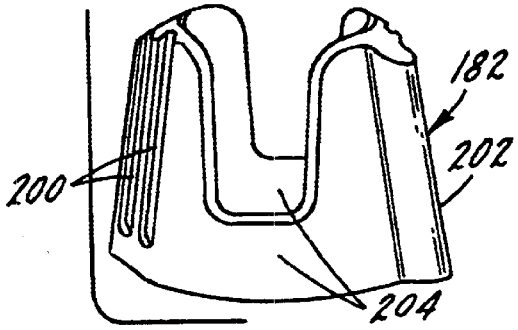

CUSHIONED GRIP TWIST-ON WIRE CONNECTOR

CROSS REFERENCE TO RELATED APPLICATION

This application is a continuation-in-part of U.S. application Ser. No. 09/374,032, filed Aug. 13, 1999, now abandoned.

BACKGROUND OF THE INVENTION

Twist-on wire connectors are well-known devices for making connections between two or more electrical wires. The connectors typically have a hollow shell or cap of insulating material. The shell is also sometimes referred to as a housing or body. The interior surface of the shell is threaded to enable the shell to grip the conductors tightly and retain the connector on the ends of the wires. The threads are often formed by a coiled metal spring inserted into the shell. The outside edges of the spring are embedded in the inner walls of the shell to hold the spring in the shell and prevent it from pulling out. The interior edges of the coil spring are engageable with the stripped ends of the wires.

Installation of a twist-on connector involves stripping the insulation from the ends of the wires and inserting the exposed conductors into the shell. Then the user twists the shell to seat the conductors firmly in the threads. It is not ordinarily necessary to pre-twist the wires as the twisting action of installation will sufficiently compress the wires together to make a sound electrical connection. The twisting action is most commonly performed using just the installer's fingers, although many connectors are designed to be compatible with ordinary wrenches or specialized wrenches so extra torque can be applied if desired. However, it is possible to apply too much torque which causes failure of the shell such as by driving the wires through the closed end of the shell. Accordingly, most electrician's prefer not to bother with pulling out a tool to apply a connector. They just use their fingers because that's the quickest, most convenient way to get the job done. Furthermore, many connector designs employ extensions commonly known as wings which provide an enlarged gripping surface for the thumb and forefinger to enable application of sufficient torque. While applying connectors with the fingers is normally fully effective, prolonged, repeated installation in this manner can lead to discomfort and fatigue. When a job requires installation of numerous connectors, the hard, plastic surface of the shell can be a pain in the fingers. Also, the usual plastic shell surface can be slippery in instances where the user's fingers are sweaty or soiled.

Dual durometer twist-on connectors having a shell with a rigid upper body and a flexible lower skirt are taught in U.S. Pat. No. 5,132,494. This connector does not place the flexible material on top of the rigid material to form a cushioned grip and all the twisting forces would have to be placed on the rigid body portion. U.S. Pat. No. 5,151,239 discloses a twist-on connector formed within an outer shell or housing having gripping ridges but these ridges do not provide a cushioned grip.

SUMMARY OF THE INVENTION

The present invention provides a twist-on wire connector with an enhanced feel for improved gripping ability and cushioning. The connector has a shell of conventional interior construction but with an exterior surface having a cushioned grip. In one embodiment the exterior surface is modified from the conventional construction to facilitate forming the cushioned grip thereon. In a second embodiment the cushioned grip is formed on a standard exterior surface. The cushioned grip has a higher coefficient of friction and a lower hardness than typical shell materials, thereby making the connector both easier to grip and more comfortable on the fingers. The improved grip reduces the need for the user to squeeze the connector as hard. This reduces fatigue when numerous connectors have to be applied. The exterior surface of the shell may have a grip mounting portion with clearly defined edges or boundaries. These edges provide a positive stop to keep the grip material from leaking during molding.

BRIEF DESCRIPTION OF THE DRAWINGS

FIG. 5 is a front elevation view of an alternate embodiment of a wire connector according to the present invention.

FIG. 6 is a side elevation view of the connector of FIG. 5.

FIG. 7 is a plan view of the connector of FIG. 5.

FIG. 8 is a section taken along line 8—8 of FIG. 5.

FIG. 9 is an exploded perspective view of the FIG. 5 wire connector's shell and cushioned grip.

FIG. 25 is a front elevation view of a still another alternate embodiment of a wire connector according to the present invention.

FIG. 26 is a side elevation view of the connector of FIG. 25.

FIG. 27 is a plan view of the connector of FIG. 25.

FIG. 28 is a section taken along line 28—28 of FIG. 25.

FIG. 29 is an exploded perspective view of the FIG. 25 wire connector's shell and cushioned grip.

FIG. 30 is a perspective view of a further alternate embodiment of a wire connector according to the present invention.

FIG. 31 is a side elevation view of the connector of FIG. 30.

FIG. 32 is a plan view of the connector of FIG. 30.

FIG. 33 is a section taken along line 33—33 of FIG. 31.

FIG. 34 is an exploded perspective view of the FIG. 30 wire connector's shell and cushioned grip.

DETAILED DESCRIPTION OF THE INVENTION

Figures 1, 2, 3, 4:
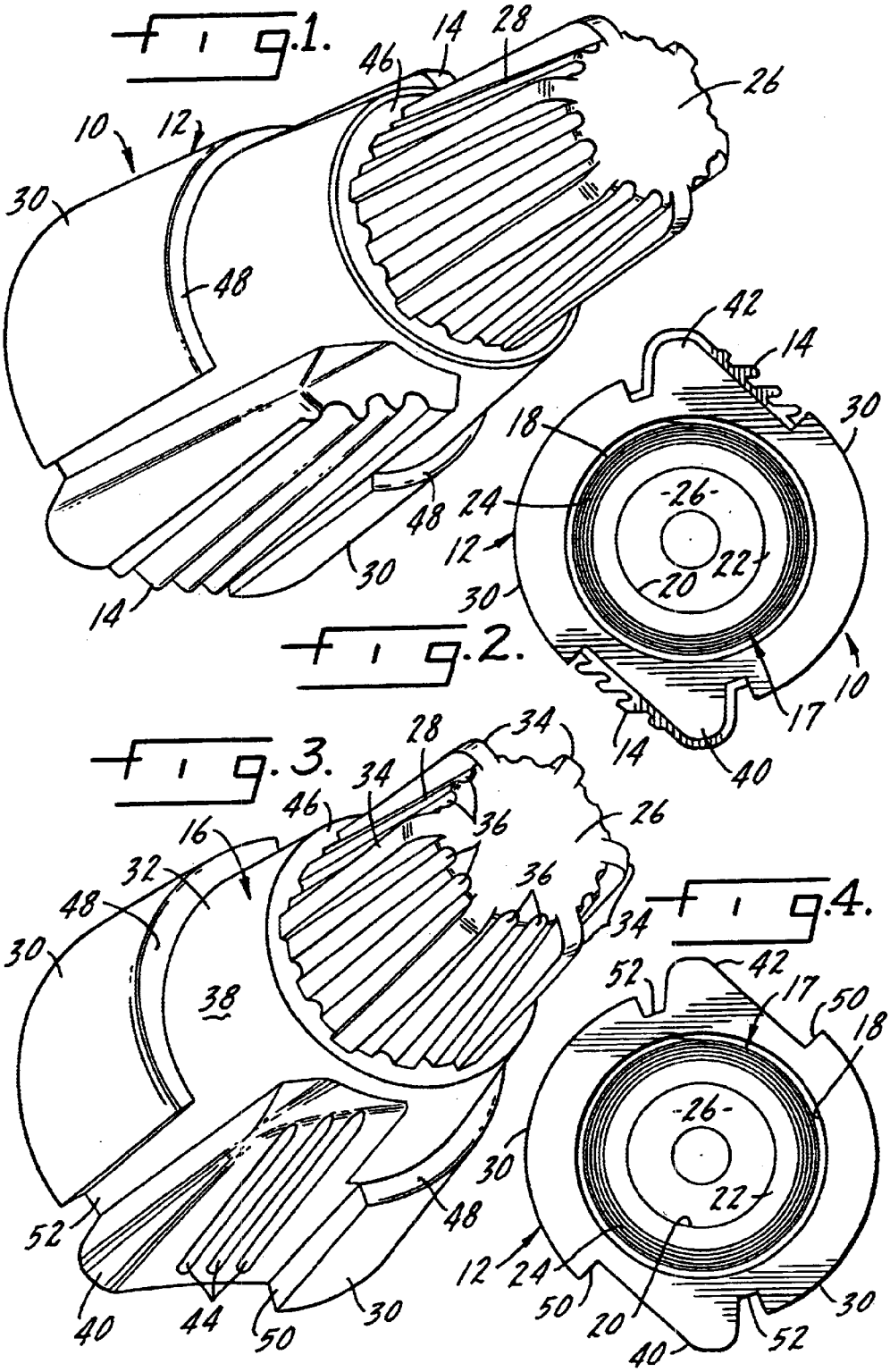
FIG. 1 is a perspective view of the wire connector assembly of the present invention.
FIG. 2 is a bottom plan view of the connector assembly.
FIG. 3 is a perspective view of the wire connector shell prior to formation of the cushioned grip.
FIG. 4 is a bottom plan view of the shell of FIG. 3.
Figure 10:
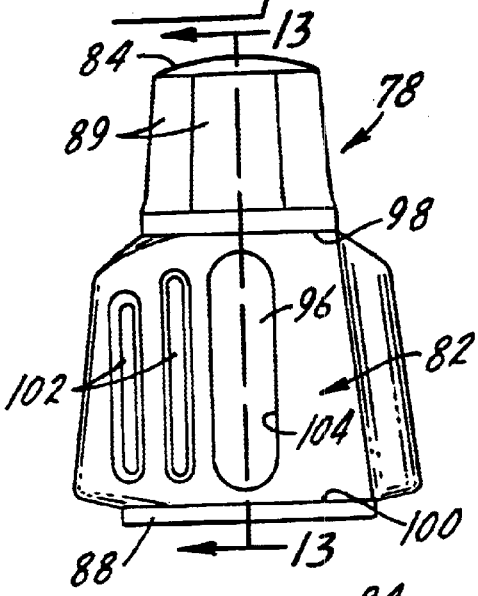
FIG. 10 is a front elevation view of a further alternate embodiment of a wire connector according to the present invention.
Figure 13:
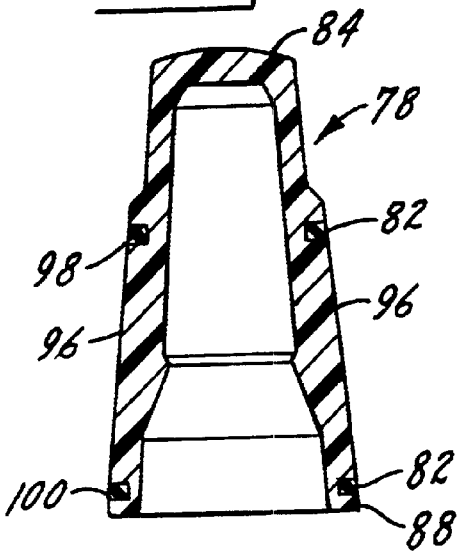
FIG. 13 is a section taken along line 13—13 of FIG. 10.
Figure 13:
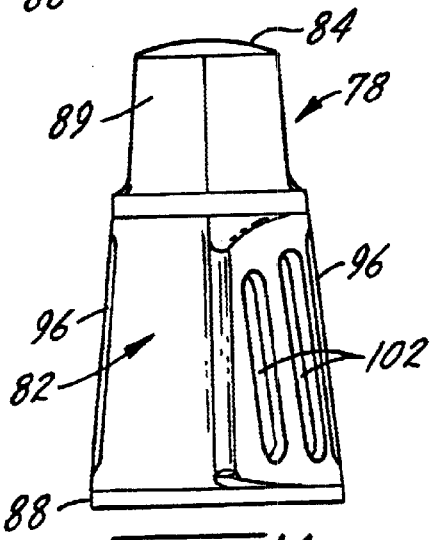
Figure 11:
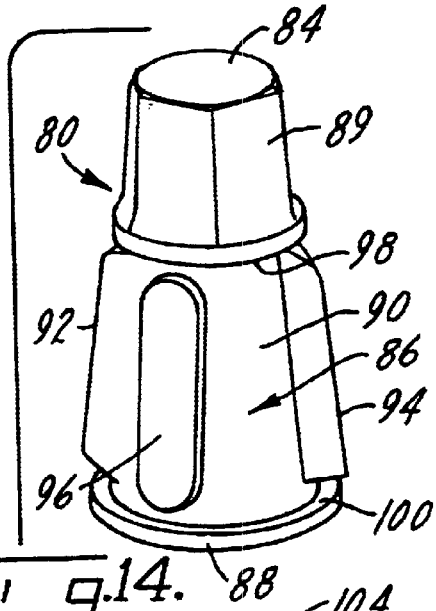
FIG. 11 is a side elevation view of the connector of FIG. 10.
Figure 14:
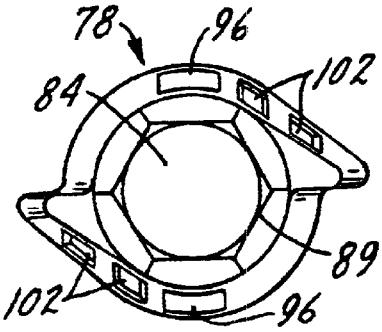
FIG. 14 is an exploded perspective view of the FIG. 10 wire connector's shell and cushioned grip.
Figure 12:
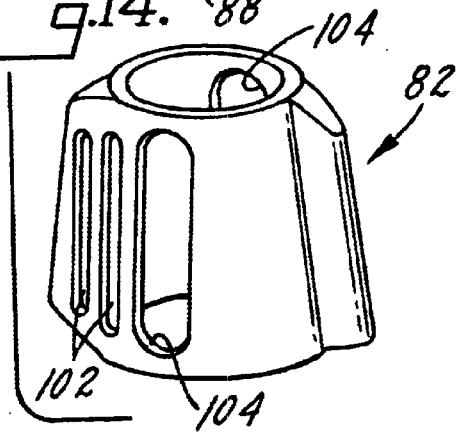
FIG. 12 is a plan view of the connector of FIG. 10.
Figure 15:
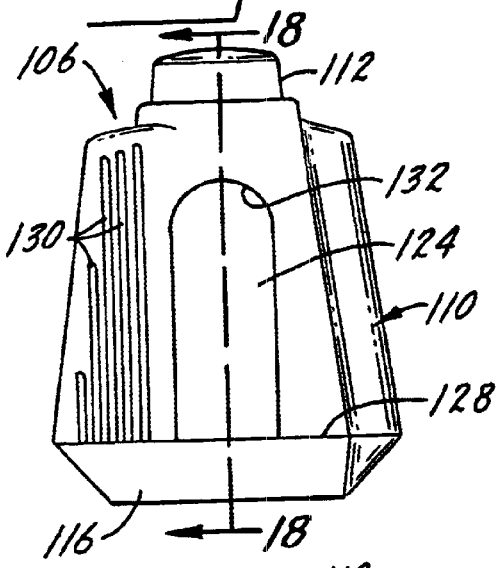
FIG. 15 is a front elevation view of yet another alternate embodiment of a wire connector according to the present invention.
Figure 18:
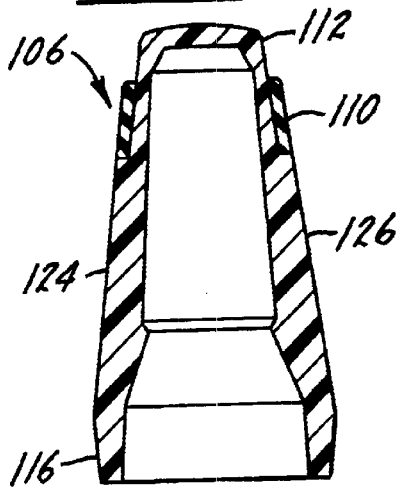
FIG. 18 is a section taken along line 18—18 of FIG. 15.
Figure 18:
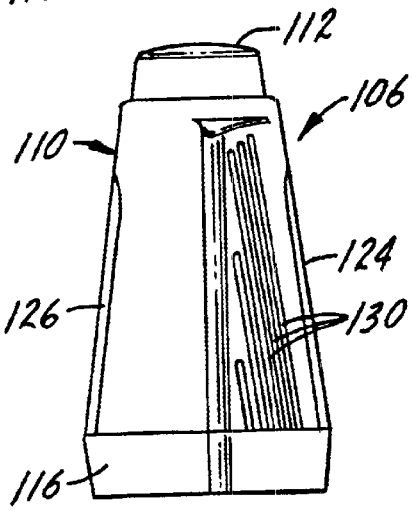
Figure 16:
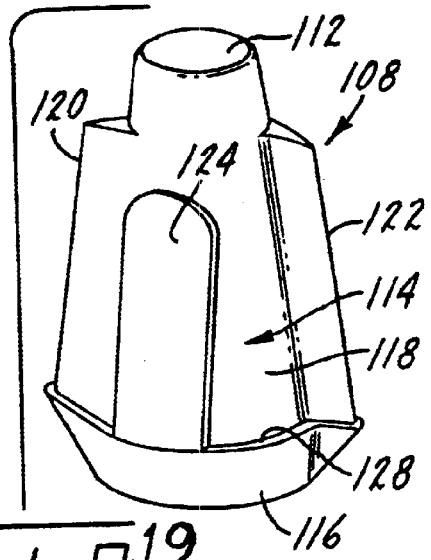
FIG. 16 is a side elevation view of the connector of FIG. 15.
Figure 19:
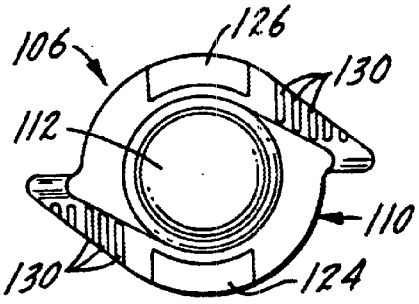
FIG. 19 is an exploded perspective view of the FIG. 15 wire connector's shell and cushioned grip.
Figure 17:
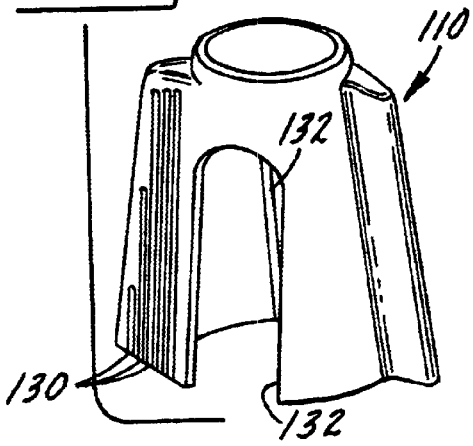
FIG. 17 is a plan view of the connector of FIG. 15.
Figure 20:
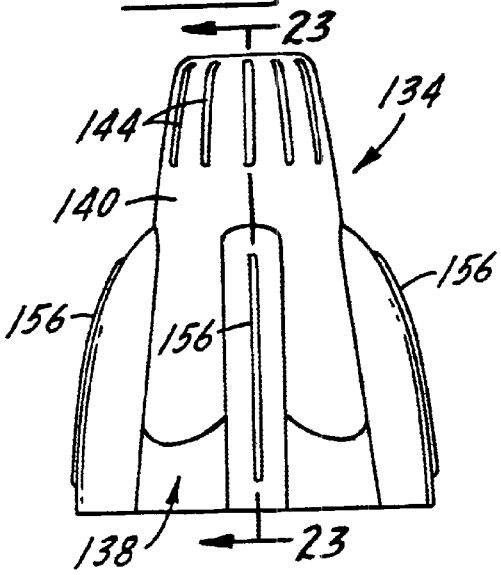
FIG. 20 is a front elevation view of a further alternate embodiment of a wire connector according to the present invention.
Figure 23:
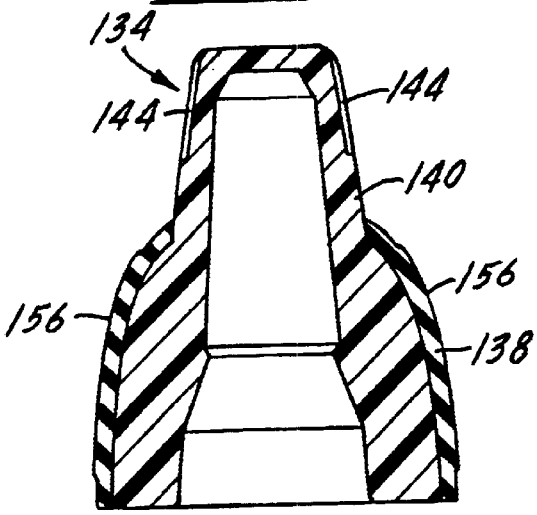
FIG. 23 is a section taken along line 23—23 of FIG. 20.
Figure 23:
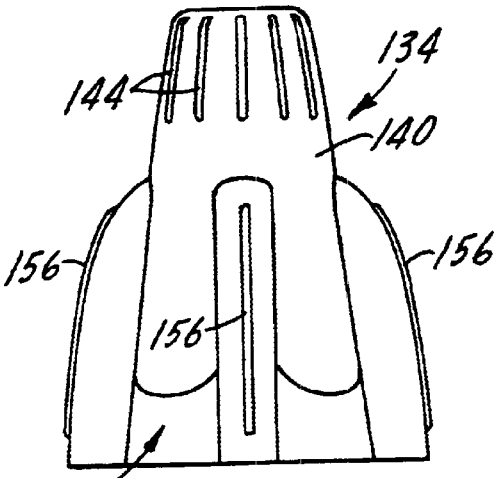
Figure 21:
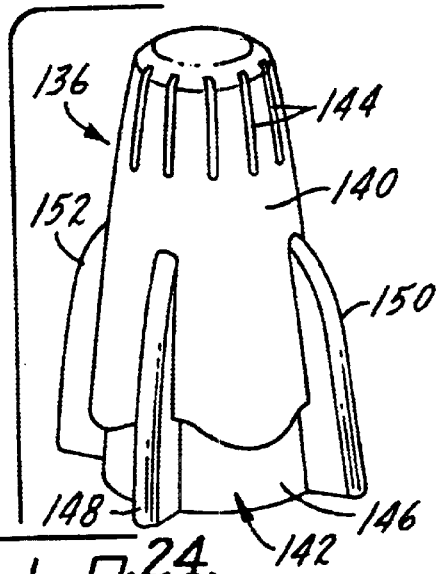
FIG. 21 is a side elevation view of the connector of FIG. 20.
Figure 24:
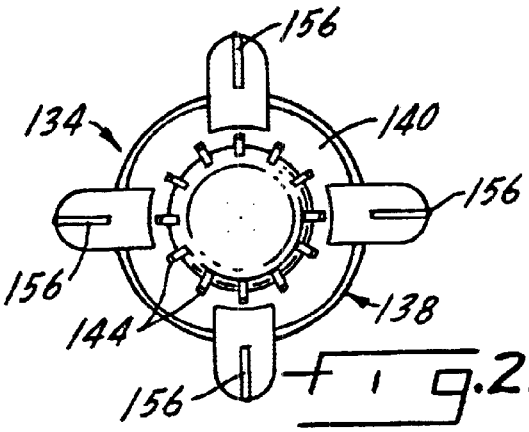
FIG. 24 is an exploded perspective view of the FIG. 20 wire connector's shell and cushioned grip.
Figure 22:
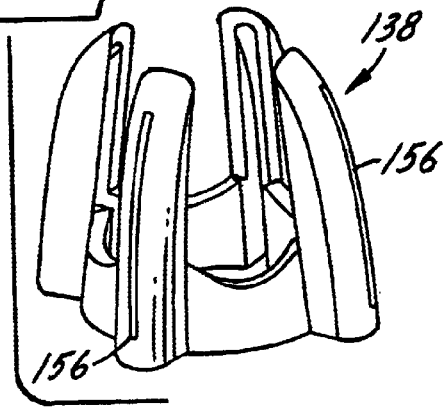
FIG. 22 is a plan view of the connector of FIG. 20.

FIGS. 1 and 2 illustrate the connector of the present invention generally at 10. The connector includes a shell 12 and a cushioned grip 14. The shell in this embodiment and the alternate forms shown below is preferably made of polypropylene although other relatively rigid, electrically insulating materials could be used, such as nylon, polycarbonate or similar thermoplastic materials. The cushioned grip in this embodiment and the alternate forms shown below is preferably made of an olefinic thermoplastic vulcanizate, such as SANTOPRENE®, a trademark of Advanced Elastomer Systems of Akron, Ohio. Rubber could also be used. Other possible materials are listed in the aforementioned U.S. Pat. No. 5,132,494, and their disclosure is incorporated by reference herein.

Details of the shell are shown in FIGS. 3 and 4. The shell has a generally frusto-conical wall 16 that defines a longitudinal axis. The wall also defines an open end 17 and an interior bore. The bore has an outer portion 18, an inner portion 20 and a transition section 22 separating the inner and outer portions. The interior surface of the wall at the outer portion 18 has threads 24 formed therein. The inner portion 20 receives a coil spring (not shown) which is embedded or otherwise fixed to the interior surface of the wall 16. An end wall 26 terminates the inner bore and defines a closed end of the shell.

The exterior surface of the shell has three main areas, a closed end section 28, a skirt 30 and a grip mounting portion 32. The closed end section may have a plurality of longitudinal ridges 34 alternating with pairs of grooves 36 as shown. The ridges are located to cooperate with a hex socket if desired. The skirt 30 preferably has a smooth outer surface. Its interior surface carries the threads 24 as explained above.

The grip mounting portion 32 in this embodiment has three parts, an annular band 38 and two longitudinal wings 40 and 42. The wings divide the skirt into two pieces and extend onto the band area 38. The wings 40, 42 protrude somewhat from the rest of the shell and provide a location where a user's fingers can easily grip and apply torque to the connector for affixing it to the wires. The wings have a series of grooves 44 formed therein. The band 38 terminates at first and second ledges 46 and 48. Each ledge extends radially of the shell. Thus, the ledges are substantially normal to the adjoining surface of the grip mounting portion. First ledge 46 extends radially inwardly from the grip mounting portion surface, while second ledge 48 extends radially outwardly therefrom. The ledges provide a definitive edge or boundary for the grip mounting surface. Similarly, the wings 40 and 42 are bounded by first and second undercuts 50 and 52 formed adjacent the skirt sections.

The cushioned grip 14 is formed such that it overlies the grip mounting portion 32. That is, the grip lies on top of the annular band 38 and the wings 40, 42. The grip will take on the grooved pattern of the wings so the grip will also have a series of grooves in the area of the wings. The connector is made by a two-step molding process. First the shell is molded, then the cushioned grip is molded over and around the shell in the area of the grip mounting portion. The ledges 46, 48 and undercuts 50, 52 provide a positive stop at the boundaries of the grip mounting portion that prevents leakage of the grip material during molding. This assures the cured grip material will be located only on the grip mounting portion and not on the skirt 30 or closed end section 28 of the shell exterior surface.

The term substantially normal as used herein means the angle between the surface of the grip mounting portion and the boundary edge is great enough to allow the molds to fit tightly against the shell and prevent leakage of the cushioned grip material during molding. It has also been found that molds with particularly close tolerances can permit the cushioned grip to be formed over a conventional twist-on connector (such as the Twister® connector sold by IDEAL Industries, Inc.) without the use of boundary edges. With closely controlled tolerances a tight fit between the connector and the mold will prevent leakage of the grip material during molding.

FIGS. 5–9 illustrate an alternate embodiment of a wire connector according to the present invention. The connector 54 includes a shell 56 and a cushioned grip 58. The exterior surface of the shell has first and second portions including a closed end section 60 and a grip mounting portion 62. The exterior of the shell also has a small, exposed area below the grip mounting portion forming a ring 64. The closed end section may have a plurality of longitudinal grooves 65 as shown. As in the previous embodiment the grip mounting portion 62 includes an annular band 66 which is divided by two longitudinal wings 68 and 70. The band 66 terminates at upper and lower undercuts 72 and 74. Each undercut extends generally radially of the shell. Thus, the undercuts are substantially normal to the adjoining surface of the grip mounting portion. In this case the upper and lower undercuts 72, 74 extend radially inwardly from the closed end section 60 and from the ring 64, respectively. The undercuts provide a definitive edge or boundary for the grip mounting portion 62. In this embodiment the undercuts 72, 74 extend throughout the entire perimeter of the grip mounting portion 62. As a result the edges of the cushioned grip are everywhere flush with the exterior surface of the shell 56. That is, the junctions of the cushioned grip 58 with the closed end section 60 and with the ring 64 present smooth surfaces, as best seen in FIG. 8.

The cushioned grip 58 is formed such that it overlies the grip mounting portion 62 but does not overlie the closed end section 60 or the ring 64. That is, the grip 58 lies on top of the annular band 66 and the wings 68, 70. The grip has a series of grooves 76 in the area of the wings. The connector 54 is made by the same two-step molding process described above. First the shell is molded, then the cushioned grip is molded over and around the shell in the area of the grip mounting portion. The undercuts 72, 74 provide a positive stop at the boundaries of the grip mounting portion that prevents leakage of the grip material during molding.

FIGS. 10–14 illustrate a further alternate embodiment of a wire connector according to the present invention. The connector 78 includes a shell 80 and a cushioned grip 82. The exterior surface of the shell has first and second portions including a closed end section 84 and a grip mounting portion 86. The exterior of the shell also has a small, exposed area below the grip mounting portion forming a ring 88. The closed end section may have a set of flat surfaces 89 forming a hexagonal closed end as shown. As in the previous embodiment the grip mounting portion 86 includes an annular band 90 which is divided by two longitudinal wings 92 and 94. The band is also interrupted in this embodiment by a pair of islands 96. The band 90 terminates at upper and lower undercuts 98 and 100. Each undercut extends generally radially of the shell. Thus, the undercuts are substantially normal to the adjoining surface of the grip mounting portion. In this case the upper and lower undercuts 98, 100 extend radially inwardly from the closed end section 84 and from the ring 88, respectively. The undercuts provide a definitive edge or boundary for the grip mounting portion 86. The undercuts 98, 100 extend throughout the entire perimeter of the grip mounting portion 86. As a result the edges of the cushioned grip are everywhere flush with the exterior surface of the shell 80.

The cushioned grip 82 is formed such that it overlies the grip mounting portion 86 but does not overlie the closed end section 84 or the ring 88. That is, the grip 82 lies on top of the annular band 90 and the wings 92, 94. The grip has a series of grooves 102 in the area of the wings. There are apertures 104 in the grip which receive the islands 96. The connector 78 is made by the same two-step molding process described above. The undercuts 98, 100 provide a positive stop at the boundaries of the grip mounting portion that prevents leakage of the grip material during molding.

It will be noted in the embodiments of FIGS. 5–9 and 10–14 the grip mounting portion is completely recessed into the outer surface of the shell. In other words, the entire perimeter of grip mounting portion is defined by an undercut. This arrangement makes it easier to control the molding of the cushioned grip.

FIGS. 15–19 show yet another alternate embodiment of a wire connector according to the present invention. The connector 106 includes a shell 108 and a cushioned grip 110. The exterior surface of the shell has first and second portions including a closed end section 112 and a grip mounting portion 114. The exterior of the shell also has a small, exposed area below the grip mounting portion forming a ring 116. As in the previous embodiment the grip mounting portion 114 includes a band 118 which is divided by two longitudinal wings 120, 122 and two peninsulas 124, 126. Both the wings and the peninsulas extend upwardly from the ring 116. The bottom edge of the band 118 terminates at a lower undercut 128. The undercut extends generally radially of the shell and substantially normal to the adjoining surface of the grip mounting portion 114.

The cushioned grip 110 is formed such that it overlies the grip mounting portion 114 but does not overlie the closed end section 112 or the ring 116. That is, the grip 110 lies on top of the band 118 and the wings 120, 122. The grip has a series of grooves 130 in the area of the wings. There are apertures 132 in the grip which receive the penisulas 124, 126. The connector 106 is made by the same two-step molding process described above. The undercut 128 provides a positive stop at the lower boundary of the grip mounting portion that prevents leakage of the grip material during molding.

FIGS. 20–24 depict a further alternate embodiment of a wire connector 134. The connector 134 includes a shell 136 and a cushioned grip 138. The exterior surface of the shell has first and second portions including a closed end section 140 and a grip mounting portion 142. The closed end section may have a plurality of longitudinal grooves 144 as shown. The grip mounting portion 142 includes an annular band 146 which is divided by four longitudinal wings, three of which are shown at 148, 150 and 152. The wings extend upwardly from the band 146 onto the closed end section 140. The bottom edge of the band 146 terminates at the lower or open end of the shell 136. The cushioned grip 138 is formed such that it overlies the grip mounting portion 142. That is, the grip 138 lies on top of the band 146 and the wings 148, 150, 152 and the fourth wing that is not visible in FIG. 24. The portion of the grip coverings the wings may have a rib 156 formed thereon.

FIGS. 25–29 illustrate still another alternate embodiment of a wire connector according to the present invention. The connector 158 includes a shell 160 and a cushioned grip 162. The shape of the shell 160 is generally similar to that of shell 12 in FIGS. 1–4. The exterior surface of the shell 160 has first and second portions including a closed end section 164 and a grip mounting portion 166. The grip mounting portion 166 includes an annular band 168 which is divided by two longitudinal wings 170 and 172. The band 168 terminates at an upper ledge 174 which extends generally radially of the shell. Thus, the ledge is substantially normal to the adjoining surface of the grip mounting portion. The ledge provides a definitive edge or boundary for the grip mounting portion 166.

The cushioned grip 162 is formed such that it overlies the grip mounting portion 166 but does not overlie the closed end section 164. That is, the grip 162 lies on top of the annular band 168 and the wings 170 and 172. In this form the grip also extends slightly beyond the open end of the shell to cushion the edges of the shell. This is best seen in FIG. 28. The grip has a series of grooves 176 in the area of the wings.

An additional alternate embodiment of the invention is shown in FIGS. 30–34. This connector 178 has a shell 180 and a cushioned grip 182. The exterior surface of the shell has first and second portions including a closed end section 184 and a grip mounting portion 186. The exterior of the shell also has a small, exposed area below the grip mounting portion forming a ring 188. The closed end section may have a plurality of longitudinal grooves 190 as shown. The grip mounting portion 186 includes a band 192 and two longitudinal wings 194, 196. The bottom edge of the band 192 terminates at a lower ledge 198 which extends generally radially of the shell and substantially normal to the adjoining surface of the grip mounting portion 186. However, unlike in several of the previous embodiments, the upper end of the band 192 is not defined by any particular feature of the shell.

The cushioned grip 182 is formed such that it overlies the grip mounting portion 186 but does not overlie the closed end section 184 or the ring 188. That is, the grip 182 lies on top of the band 192 and the wings 194, 196. The grip has a series of grooves 200 in the area of the wings. As best seen in FIG. 34, the grip 182 comprises two wing-covering pad areas 202 joined by a pair of straps 204. Together the pads and straps encircle the shell 180. This embodiment, as well as those of FIGS. 15–19 and FIGS. 25–29, has the advantage of requiring a less complicated mold. That is, the shells and complete connectors of these embodiments can be extracted axially from a mold cavity and therefore there is no need to split the mold axially.

While a preferred form of the invention has been shown and described, it will be realized that alterations and modifications may be made thereto without departing from the scope of the following claims. For example, while the grip mounting portion is shown having a continuous band around the middle of the shell, it could be otherwise. The cushioned grip might be formed of discrete, separate pads of elastomer rather than a continuous band. Also, it will be realized that the wings are not required. However, if wings are provided it is preferable to put the cushioned grip over them, since a user is almost certain to apply installation torque to the wings.

What is claimed is:

1. A twist-on wire connector, comprising:

a shell made of relatively rigid material and having an exterior surface which includes a closed end section and a grip mounting portion; and a cushioned grip made of material that is softer than said relatively rigid material, said cushioned grip being arranged to cover the grip mounting portion of the exterior surface while leaving the closed end section of the exterior surface uncovered, said grip mounting portion having an area that is large enough to cushion a user's fingers during installation of the connector, substantially all of said material that is softer than the relatively rigid material being supported by the grip mounting port on such that the shape of the cushioned grip does not change during normal use of the connector.

2. The wire connector of claim 1 wherein the grip mounting portion terminates at at least one boundary edge that is substantially normal to the grip mounting portion.

3. The wire connector of claim 1 wherein the grip mounting portion further comprises at least one wing.

4. The wire connector of claim 1 wherein the shell has a generally frusto-conical shape defining a longitudinal axis, and the grip mounting portion has at least one boundary defined by a ledge extending radially of said axis.

5. The wire connector of claim 4 wherein the grip mounting portion further comprises at least one wing which at least partially terminates laterally at first and second undercuts.

6. The wire connector of claim 1 wherein the shell has a generally frusto-conical shape defining a longitudinal axis, the closed end section being located on one side of the grip mounting portion and the shell exterior surface further comprises a ring on the opposite side of the grip mounting portion, the intersection of the grip mounting portion and the closed end section being defined by an upper undercut extending radially of said axis, and the intersection between the grip mounting portion and the ring being defined by a lower undercut extending radially of said axis.

7. The wire connector of claim 6 wherein the grip mounting portion further comprises at least one wing which is bounded by the ring at first and second undercuts.

8. The wire connector of claim 1 wherein the cushioned grip has a plurality of grooves therein.

9. The wire connector of claim 1 wherein the shell has a generally frusto-conical shape defining a longitudinal axis and an open end, the cushioned grip extending longitudinally from the open end toward the closed end section.

10. The wire connector of claim 9 wherein of the exterior surface further comprises a ring adjacent the open end the grip mounting portion extending from the ring to the closed end section.

11. A twist-on wire connector, comprising:

a shell made of material having a first coefficient of friction and having an exterior surface which includes a closed end section and a grip mounting portion; and a cushioned grip made of material having a second coefficient of friction that is higher than the first coefficient of friction, said cushioned grip being arranged to cover the first grip mounting portion of the exterior surface while leaving the closed end section of the exterior surface uncovered, said grip mounting portion having an area that is large enough to cushion a user's fingers during installation of the connector substantially all of said material having a second coefficient of friction being supported by the grip mounting portion such that the shape of the cushioned grip does not change during normal use of the connector.

12. The wire connector of claim 11 wherein the grip mounting portion terminates at at least one boundary edge that is substantially normal to the grip mounting portion.

13. The wire connector of claim 11 wherein the grip mounting portion further comprises at least one wing.

14. The wire connector of claim 11 wherein the shell has a generally frusto-conical shape defining a longitudinal axis, and the grip mounting portion has at least one boundary defined by a ledge extending radially of said axis.

15. The wire connector of claim 14 wherein the grip mounting portion further comprises at least one wing which at least partially terminates laterally at first and second undercuts.

16. The wire connector of claim 11 wherein the shell has a generally frusto-conical shape defining a longitudinal axis, the closed end section being located on one side of the grip mounting portion and the shell exterior surface further comprises a ring on the opposite side of the grip mounting portion, the intersection of the grip mounting portion and the closed end section being defined by an upper undercut extending radially of said axis, and the intersection between the grip mounting portion and the ring being defined by a lower undercut extending radially of said axis.

17. The wire connector of claim 16 wherein the grip mounting portion further comprises at least one wing which is bounded by the ring at first and second undercuts.

18. The wire connector of claim 11 wherein the cushioned grip has a plurality of grooves therein.

19. The wire connector of claim 11 wherein the shell has a generally frusto-conical shape defining a longitudinal axis and an open end, the cushioned grip extending longitudinally from the open end toward the closed end section.

20. The wire connector of claim 19 wherein the exterior surface further comprises a ring adjacent the open end the grip mounting portion extending from the ring to the closed end section.

21. A twist-on wire connector, comprising:

a shell made of relatively rigid material, the shell having an end wall joined to a generally frusto-conical wall that defines a longitudinal axis, an exterior surface, and an open end, and the shell further having a longitudinally extending wing protruding from the exterior surface of the frusto-conical wall; and a cushioned grip made of material that is softer than said relatively rigid material, said cushioned grip being arranged to cover at least a portion of the wing that is large enough to cushion a user's fingers during installation of the connector, substantially, all of said material that is softer than the relatively rigid material being supported by the wing such that the shape of the cushioned grip does not change during normal use of the connector.

22. The wire connector of claim 21 wherein the exterior surface of the frusto-conical wall defines a grip mounting portion having an area that is large enough to cushion a user's fingers during installation of the connector, the cushioned grip being arranged to cover the grip mounting portion, substantially all of said material that is softer than the relatively rigid material being supported by the wing or the grip mounting portion such that the shape of the cushioned grip does not change during normal use of the connector.

23. The wire connector of claim 22 wherein substantially all of said material that is softer than the relatively rigid material is supported by one of the wing and the grip mounting portion such that the shape of the cushioned grip does not change during normal use of the connector.

24. The wire connector of claim 22 wherein the grip mounting portion includes an annular band extending from the open end partially toward the end wall.

25. The wire connector of claim 24 wherein the annular band terminates at an upper ledge which is substantially normal to the grip mounting portion.

26. The wire connector of claim 24 wherein the shell includes a second wing protruding from the exterior surface of the frusto-conical wall, the annular band being divided by the two wings and the cushioned grip extending at least partially on to both wings.

27. The wire connector of claim 21 wherein exterior surface of the frusto-conical wall defines a grip mounting portion, a closed end section and a ring, the grip mounting portion being longitudinally located between the closed end section and the ring, and the grip mounting portion having an area that is large enough to cushion a user's fingers during installation of the connector, the cushioned grip being arranged to cover the grip mounting portion.

28. The wire connector of claim 21 wherein substantially all of said material that is softer than the relatively rigid material is supported by the wing such that the shape of the cushioned grip does not change during normal use of the connector.

* * * * *